US010472874B2

(12) United States Patent
Gall

(10) Patent No.: US 10,472,874 B2
(45) Date of Patent: Nov. 12, 2019

(54) AUTOMATIC PNEUMATICALLY-ACTUATED GATE AND LATCH

(71) Applicant: Bonnie Bergeron, Duncan (CA)

(72) Inventor: Lindsay Gall, Duncan (CA)

( * ) Notice: Subject to any disclaimer, the term of this patent is extended or adjusted under 35 U.S.C. 154(b) by 0 days.

(21) Appl. No.: 15/539,111

(22) PCT Filed: Dec. 22, 2015

(86) PCT No.: PCT/IB2015/059894
§ 371 (c)(1),
(2) Date: Jun. 22, 2017

(87) PCT Pub. No.: WO2016/103186
PCT Pub. Date: Jun. 30, 2016

(65) Prior Publication Data

US 2017/0370144 A1 Dec. 28, 2017

Related U.S. Application Data

(60) Provisional application No. 62/095,126, filed on Dec. 22, 2014.

(51) Int. Cl.
*E05F 11/08* (2006.01)
*E05F 15/53* (2015.01)
(Continued)

(52) U.S. Cl.
CPC ..... *E05F 15/53* (2015.01); *E01F 13/06* (2013.01); *E05B 51/02* (2013.01); *E05B 63/248* (2013.01);
(Continued)

(58) Field of Classification Search
CPC ..... E05F 15/53; E05F 15/47; E05B 17/0029; E05B 63/248; E05Y 2900/40
(Continued)

(56) References Cited

U.S. PATENT DOCUMENTS 1,859,364 A 5/1932 Haskell
2,592,891 A 4/1952 Hall
(Continued)

FOREIGN PATENT DOCUMENTS

CA 2639433 A1 * 10/2009
GB 2203486 A * 10/1988

OTHER PUBLICATIONS

WIPO, Canadian International Searching Authority, International Search Report and Written Opinion dated Apr. 8, 2016, International Patent Application No. PCT/IB2015/059894 , 9 Pages.

*Primary Examiner* — Jerry E Redman
(74) *Attorney, Agent, or Firm* — Baumgartner Patent Law; Marc Baumgartner

(57) ABSTRACT

A pneumatically actuated gate assembly, and a kit for making the assembly are provided. The assembly comprising: a gate with an at least one hinge; a battery; a compressed gas cylinder; a first support pivotally supporting the gate with the hinges; a second support; a latch movably mounted on the gate; a keeper for releasable engagement with the latch, the keeper mounted on the second support; a compressed gas system in fluid communication with the compressed gas cylinder; a gate pneumatic system in fluid communication with the compressed gas system, and including a gate pneumatic ram pivotally attached to the first support at a proximal end and attached to the gate at a distal end; a latch pneumatic system in fluid communication with the compressed gas system, and including a latch pneumatic ram attached to the gate and the latch; and a controller, wherein the compressed gas system is configured to provide a controllable pressure of gas to the gate pneumatic system and the latch pneumatic system under control of the controller. A method of using the assembly is also provided.

9 Claims, 7 Drawing Sheets

(51) Int. Cl.

| | |
|---|---|
| ***E05F 15/77*** | (2015.01) |
| ***E05F 15/47*** | (2015.01) |
| ***E01F 13/06*** | (2006.01) |
| ***E05B 51/02*** | (2006.01) |
| ***E05B 63/24*** | (2006.01) |
| *E05F 15/60* | (2015.01) |

(52) U.S. Cl.
CPC ..... *E05F 15/47* (2015.01); *E05F 15/77* (2015.01); *E05F 15/60* (2015.01); *E05Y 2201/22* (2013.01); *E05Y 2400/612* (2013.01); *E05Y 2400/628* (2013.01); *E05Y 2900/40* (2013.01); *F15B 2211/30525* (2013.01); *F15B 2211/50554* (2013.01)

(58) Field of Classification Search
USPC ..... 49/21, 49, 137, 339, 340, 344
See application file for complete search history.

(56) References Cited

U.S. PATENT DOCUMENTS 3,500,585 A 3/1970 Vollmar
3,645,042 A 2/1972 Bolli
3,936,977 A 2/1976 Runft
4,231,190 A 11/1980 Tieben
4,330,958 A * 5/1982 Richmond ..... E05B 47/026 49/280
4,638,595 A 1/1987 Rivero
4,638,597 A * 1/1987 Lybecker ..... E05F 15/53 49/340
5,050,344 A * 9/1991 Skeem ..... E05F 1/066 49/237
5,269,098 A 12/1993 Redman
5,515,649 A 4/1996 Strab
6,059,346 A 5/2000 Moon
6,256,928 B1 * 7/2001 Skeem ..... E05F 15/622 49/340
7,367,161 B1 * 5/2008 Jones ..... E05F 15/614 49/334
7,543,410 B2 6/2009 Baczewski
8,225,458 B1 * 7/2012 Hoffberg ..... E05F 3/102 16/49
2004/0261319 A1 * 12/2004 Kennedy ..... F15B 11/076 49/339
2006/0267532 A1 * 11/2006 Olmsted ..... E05F 15/63 318/466
2006/0284428 A1 * 12/2006 Beadle ..... A01K 1/0017 292/302
2008/0115543 A1 * 5/2008 Lanigan ..... E05B 47/0046 70/57.1
2009/0072580 A1 * 3/2009 Wojtach, Jr. ..... E05F 15/53 296/146.4
2009/0205256 A1 8/2009 Valois
2009/0206777 A1 * 8/2009 Taheri ..... E05F 15/63 318/15
2014/0150344 A1 * 6/2014 Adriaansen ..... E05D 15/10 49/258
2015/0233166 A1 * 8/2015 Trinciarelli ..... E06B 3/92 49/110
2016/0245387 A1 * 8/2016 Pandian ..... B64D 29/06
2016/0376824 A1 * 12/2016 Talpe ..... E05F 3/108 16/52
2018/0155950 A1 * 6/2018 Van Wyk ..... F21S 8/08
2019/0024454 A1 * 1/2019 Maddamma ..... E05F 15/56

* cited by examiner

AUTOMATIC PNEUMATICALLY-ACTUATED GATE AND LATCH

CROSS REFERENCE TO RELATED APPLICATIONS

The present invention is filed under 35 U.S.C. § 371 as the U.S. national phase of International Application No. PCT/IB2015/059894, filed Dec. 22, 2015, which designated the U.S. and claims the benefit of U.S. Provisional Patent Application No. 62/095,126, filed Dec. 22, 2014. The above-identified applications are incorporated herein by reference in their entirety.

FIELD

The present technology relates to a combined gate and latch opener. More specifically, it relates to a pneumatically actuated combination that is remotely controlled. It is designed especially for off the grid applications.

BACKGROUND

There are numerous hydraulically or pneumatically actuated gate/door openers and closers. Hydraulically actuated openers and closers require motors, pumps and reservoirs, and are therefore relatively large. They require a significant amount of power for actuation and are therefore best suited to industrial applications.

For example, U.S. Pat. No. 4,416,085 discloses an automatic gate opening device where commercial electricity is not economically available, however, it requires a significant amount of power. A hydraulic cylinder operated by a motor and bidirectional gear pump moves a cylinder rod which connects to an opening rod. The opening rod is pivotally connected to one end to the gate and on the other end to a stationary location. Due to pivotal connections and a pivotal linkage near the middle of the opening rod, the gate may be opened and closed by the hydraulic cylinder. The hydraulic cylinder is also pivotally mounted. Electronic controls may be operated by a number of different type sensors, including limit switches on the hydraulic cylinder, sensors for detecting the gate location, manual switches or other traditional vehicle approach sensors. Power is provided by a storage battery, which battery can be recharged during daylight hours at a solar panel or by a traditional battery charger. The system is electrically driven. As the bidirectional pump is driven by a motor, this system requires a significant amount of power to operate. Further, in order for the hydraulic ram to effectively actuate opening and closing of the gate, a long opening rod is required, that includes a pivot linkage. This opening rod could easily be damaged as it is obtrusive. Although there is a timing circuit, it does not appear to be able to adjust the rate of opening and closing.

With regard to pneumatic actuators, U.S. Pat. No. 6,256,928 discloses an automated gate assembly, includes (i) a post; (ii) a gate pivotally coupled to the post, the gate pivoting between an open position and a closed position; and (iii) a gate opening assembly coupled to the gate. The gate opening assembly includes: (i) a pivoting assembly which selectively and simultaneously moves in both a linear and arcuate direction; and (ii) a connector connecting the pivoting assembly to the gate whereby actuation of the pivoting assembly rotates the gate from the open position to the closed position. The automatic gate assembly is particularly advantageous for mounting an automatic gate opening assembly on one side of a square or rectangular post while the gate is pivotally mounted on an adjacent side. A connector is able to readily clear the corner between the adjacent sides of the posts because of the unique configuration of the opening assembly. Any type of linear actuator, including a pneumatic actuator is contemplated. The assembly has at least one motor and hence requires a significant amount of power in order to function. Again, a long opening rod is required, that includes a pivot linkage. This opening rod could easily be damaged as it is obtrusive. This system has no provisions for adjusting the rate of opening and closing.

U.S. Pat. No. 5,050,344 discloses an automatic gate opening device which simultaneously lifts and opens the gate. A drive mechanism forces the gate upward, while a roller bearing following a helical slot in a tube causes rotation of the gate. Hinges are provided which allow simultaneous rotational and linear displacement of the gate. A pneumatic actuator is used. This requires an air compressor and the associated power in order to function, hence is not suitable for off the grid applications. This design is subject to malfunctioning if dirt or debris enter the helical slot. A timer is included in the control mechanism to control the amount of time that the air compressor is active.

U.S. Pat. No. 4,638,597 discloses a modular gate opening apparatus comprising a mounting frame which can be used to buttress a deteriorated fence post or secured to a new fence post. A vertical portion of the frame comprises a plurality of apertures in axial alignment allowing a wide variety of fastening means to be used to secure the frame in a number of configurations. A gate-receiving bracket is hingedly secured to the frame and is adapted to accommodate a wide variety of gate sizes. Actuator means are provided to move the gate receiving bracket, and the gate carried thereon, between an open and a closed position. The gate opening apparatus is electrically powered. In the preferred embodiment, an electric motor with a screw jack is used to actuate the opening apparatus. This requires a significant amount of power and is therefore not suited to off the grid applications. The opening apparatus includes a long opening rod that includes a pivot linkage. This opening rod could easily be damaged as it is obtrusive. The rate of opening and closing cannot be adjusted.

Various other types of gate or door opening devices have been designed in the past to utilize pneumatic cylinders and a mechanical linkage. U.S. Pat. No. 3,936,977 discloses a double acting power cylinder. A pivotal interconnecting linkage is utilized to open a door in response to the movement of a piston within the cylinder. It utilizes an air supply employed in commercial establishments, which is clearly an electrically powered compressor, as it is stated "The air supply system preferably is provided with a suitable manually operable power release valve unit 85 such that in the event of any malfunction, associated with, for example, a loss of electrical power, the power cylinder 9 can be completely exhausted." This is therefore not suited to off the grid applications. Further, it is relatively complex.

Other types of gate opening devices have utilized a ram such as that shown in U.S. Pat. No. 3,500,585. An electric motor drives the ram. Further examples of gate opening devices are shown in U.S. Pat. Nos. 3,645,042, 2,592,891 and 4,231,190. U.S. Pat. No. 3,645,042 discloses a pneumatically actuated opener and spring closure for a door. U.S. Pat. No. 2,592,891 discloses an electric motor driven opener. U.S. Pat. No. 4,231,190 discloses a chain drive opener that is remotely controlled.

A pneumatic catch mechanism is disclosed in U.S. Pat. No. 6,408,571. More specifically, it discloses an automatic closing gate having a gate post and at least one self-closing hinge attaching the gate to the gate post. A catch post having a catch holds the gate in an open position for a period of time. The catch releases the gate after the period of time and the gate is free to swing shut. The catch is manually engaged and pneumatically released. The time that the gate is open is controlled by the rate of travel of the piston. The gate is self-closing so there is no control of the speed of closing. Further, the gate must be opened manually.

What is needed is a gate opener and closer coupled to a latch opener that can be operated with a source of compressed gas and an electrical source for powering the opening and closing of valves, and solenoid valves. The compressed gas would be provided as a canister as opposed to a compressor or other apparatus requiring an electrical, solar, gas or diesel input. Preferably, the source of compressed gas is a carbon dioxide canister. This would allow for the opener, closer and latch opener to operate off the grid and without additional equipment. It would be advantageous if the system could be used for the opening and closing of large gates, such as those in industrial, farm and ranch settings. It would be a further advantage if the actuator inherently provided a safety stop. It would be of further advantage if the rate of opening and closing could be optimized for the location and user requirements.

SUMMARY

The present technology is a gate opener and closer coupled to a latch opener that can be operated with a compressed gas canister and a battery for powering the opening and closing of valves, solenoid valves and the like. The compressed gas is provided as a canister as opposed to a compressor or other apparatus requiring an electrical, solar, gas or diesel input. The source of compressed gas is preferably a carbon dioxide canister. The power requirements are very low and therefore a battery can be used as the electrical source. This would allow for the opener, closer and latch opener to operate as a standalone, self contained system that can be used off the grid and without additional equipment. The system can be used for the opening and closing of large gates, such as those in industrial, farm and ranch settings. A further advantage is that the actuator inherently provided a safety stop. A further advantage is that the rate of opening and closing can be optimized for the location and user requirements—changes can be made as required on the fly.

In one embodiment, a kit is provided. The kit is for use with a gate, a battery and a compressed gas cylinder and comprises: a compressed gas system including, in fluid communication, a pressure gauge, an adjustable pressure regulator, a common pneumatic line, a second pressure gauge and a control valve; a gate pneumatic system in fluid communication with the control valve, the gate pneumatic system including, in fluid communication, an open gate pneumatic line, a closed gate pneumatic line and a gate pneumatic ram; a latch pneumatic system in fluid communication with the control valve, the latch pneumatic system including, in fluid communication, a latch pneumatic line and a latch pneumatic ram; and a controller, the controller in electrical communication with the control valve.

The kit may further comprise a first flow controller on a first outlet of the gate pneumatic ram and a second flow controller on a second outlet of the gate pneumatic ram.

In the kit, the first flow controller may be a first adjustable valve and the second flow controller may be a second adjustable valve.

In the kit, the controller may be a solenoid actuator.

The kit may further comprise a remote control transmitter and a remote control receiver, the remote control transmitter for electronic communication with the remote control receiver, the remote control receiver in electrical communication with the solenoid actuator.

The kit may further comprise a control box for housing the pressure gauge, the adjustable regulator, the second pressure gauge, the control valve, the solenoid actuator and the remote control receiver.

The kit may include the battery, the battery for electrical communication with the solenoid actuator.

In the kit, the battery may be housed in the control box.

The kit may include the compressed gas cylinder.

In the kit, the compressed gas cylinder may be a compressed carbon dioxide cylinder.

The kit may further comprise a mechanical system, the mechanical system including a mounting assembly for attaching a proximal end of the gate pneumatic ram to the control box, attachers for attaching a distal end of the gate pneumatic ram to the gate, attachers for attaching the latch pneumatic ram to a latch on the gate, the latch and a keeper.

In the kit, the mounting assembly may include a two dimensional gimbal.

In another embodiment, a pneumatically actuated gate assembly is provided, the assembly comprising: a gate with an at least one hinge; a battery; a compressed gas cylinder; a first support pivotally supporting the gate with the hinges; a second support; a latch movably mounted on the gate; a keeper for releasable engagement with the latch, the keeper mounted on the second support; a compressed gas system in fluid communication with the compressed gas cylinder; a gate pneumatic system in fluid communication with the compressed gas system, and including a gate pneumatic ram pivotally attached to the first support at a proximal end and attached to the gate at a distal end; a latch pneumatic system in fluid communication with the compressed gas system, and including a latch pneumatic ram attached to the gate and the latch; and a controller, wherein the compressed gas system is configured to provide a controllable pressure of gas to the gate pneumatic system and the latch pneumatic system is under control of the controller.

In the assembly, the compressed gas system may be configured to provide between about 241 kPa to about 861 kPa pressure when the controller is actuated.

In the assembly, the compressed gas cylinder may be a compressed carbon dioxide cylinder.

In the assembly, the controller may be a solenoid actuator.

The assembly may further comprise a first flow controller on a first outlet of the gate pneumatic ram and a second flow controller on a second outlet of the gate pneumatic ram.

In the assembly the first flow controller may be a first adjustable valve and the second flow controller may be a second adjustable valve.

The assembly may further comprise a remote control transmitter and a remote control receiver, the remote control transmitter for electronic communication with the remote control receiver, the remote control receiver in electrical communication with the solenoid actuator.

In the assembly the gate pneumatic ram may be attached at the proximal end to the gate with a mounting assembly that includes a two dimensional gimbal.

In the assembly, the latch pneumatic actuator may be spring-loaded.

In another embodiment, a method of opening and closing a gate and a latch or closing and opening a gate and a latch is provided, the method comprising utilizing the assembly described above; actuating the controller; and de-actuating the controller.

In the method the actuating and de-actuating may be controlled remotely.

The method may further comprise adjusting a first adjustable valve on a first outlet of the pneumatic ram and adjusting a second adjustable valve on a second outlet of the pneumatic ram to control the speed of opening and closing the gate.

FIGURES

DESCRIPTION

Figure 1:
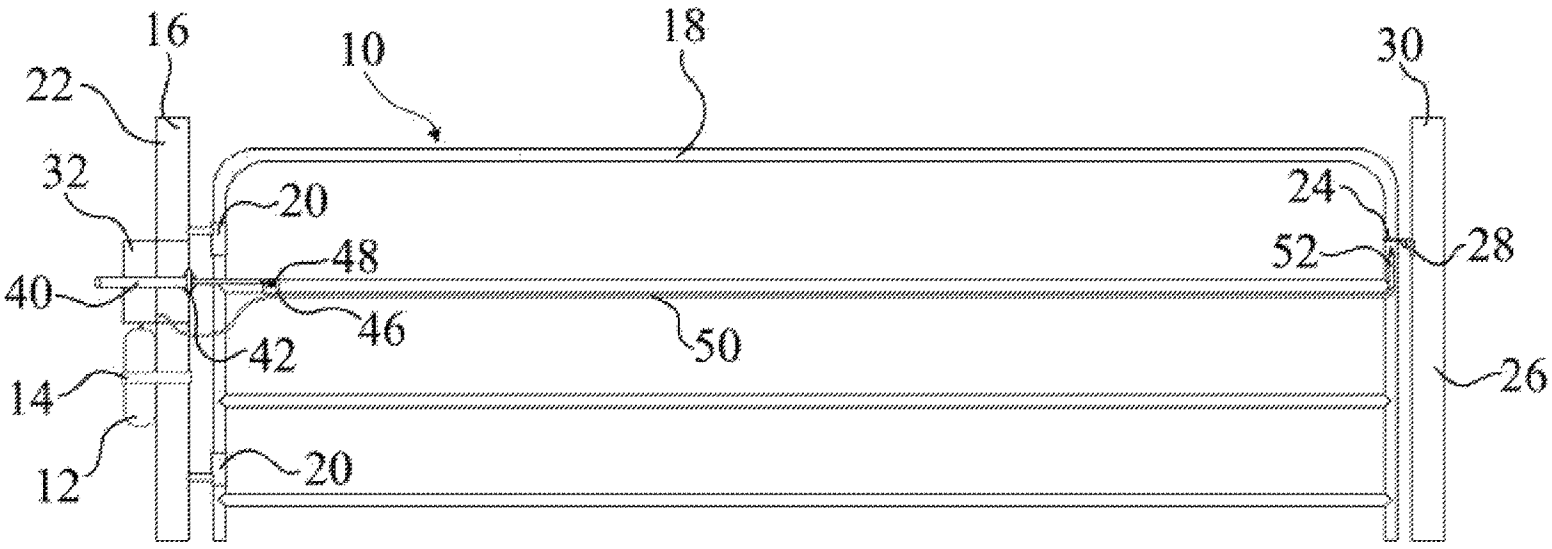
FIG. 1 is a side view of the gate assembly of the present technology.

Except as otherwise expressly provided, the following rules of interpretation apply to this specification (written description, claims and drawings): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, The terms "comprising," "having," "including," and "containing" are to be construed as open ended terms (i.e., meaning "including, but not limited to,") unless otherwise noted.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

The present technology is suited for use in housing, retail and industrial facilities requiring controlled door and gate opening and closing for security purposes, keeping out animals, and the like. The technology is also suited for disabled persons requiring remote and automatic door opening capabilities accessible from, for example, a wheelchair. It is especially suited to remote locations or off the grid locations, such as entrances to oil field sites, farmer's fields and ranches. It is a low cost, low power, closed loop system that does not require infrastructure such as plumbing or power. It is a self-contained, stand alone system. It is safe to use. Unlike hydraulic rams and linear actuators, pneumatic rams will cease to function if, for example, the gate is hit by a car and the system is damaged. Carbon dioxide is a very safe gas to use, as it is non-combustible, inert, non-toxic and non-corrosive. Other features that make carbon dioxide the preferred gas include its compressibility (1 pound of carbon dioxide gas is equal to 8.741 cubic feet of gas), and therefore a higher volume of gas can be stored per tank than with other gases, it is a relatively low pressure gas, maintaining a tank pressure less than a third that of other common gases like nitrogen or scuba tanks, again adding to its safety attributes, and it is readily available.

The present system can open a gate weighing up to about 272 kilograms (kg) that is up to about 4.9 metres (16 feet) in length. Significantly, with an about 9 kg compressed carbon dioxide canister, it can open this gate about 2000 times. This realistically allows for opening and closing of the gate for a year on one canister. Movement of the gate is very smooth, unlike those controlled with linear actuators. The technology supports automatic gate opening of both one and two gate designs.

Definitions

In the context of the present technology, a gate opener is understood to mean a gate or door opener and closer.

In the context of the present technology, a latch opener is understood to mean a latch or catch opener.

DETAILED DESCRIPTION

A method of opening and closing a gate and latch follows: A remote control device, which is preferably hand held, is used to signal a low voltage solenoid actuator to open or close a solenoid actuated control valve. This control valve has open/close pipe connections to a gate pneumatic ram bolted both to the gate to be controlled and the gate post or other structural element, such as a wall. Opening the control valve results in pressure being applied, the piston of the gate pneumatic ram is urged from the cylinder which opens the gate to its selected open position. Pressing the remote control device again results in the control valve closing and urging the piston of the gate pneumatic ram to retract and thus close the gate. Additionally, when the remote device is first pressed (gate open mode), pressure exerted on the latch pneumatic ram urges the latch of the latch assembly to disengage, thus allowing the gate to open. Upon gate closing, the latch will automatically lock back into position.

A gate assembly, generally referred to as 10, is shown in FIG. 1. It has a compressed gas cylinder 12 that is attached with a strap 14 to a first fence post 16 or other suitable structure proximate a gate 18. The gas cylinder 12 is a compressed carbon dioxide cylinder. The gate 18 can be seen to have hinges 20 on a first side 22, that are attached to the fence post 16 and a latch 24 on a second side 26 that cooperates with a keeper 28. The keeper 28 is attached to a second fence post 30 or other suitable structure proximate the gate 18. A control box 32 is also attached to the fence post 16 or other suitable structure. A gate pneumatic ram 40 is pivotally attached to via a mounting assembly 42 to the control box 32 at a cylinder distal end 44 (see FIG. 3) and to a bracket 46 on the gate 18 at a piston distal end 48 (see FIG. 3). A latch pneumatic line 50 can be seen extending from the control box 22 across the gate 18 to a latch pneumatic ram 52.

Figure 2:
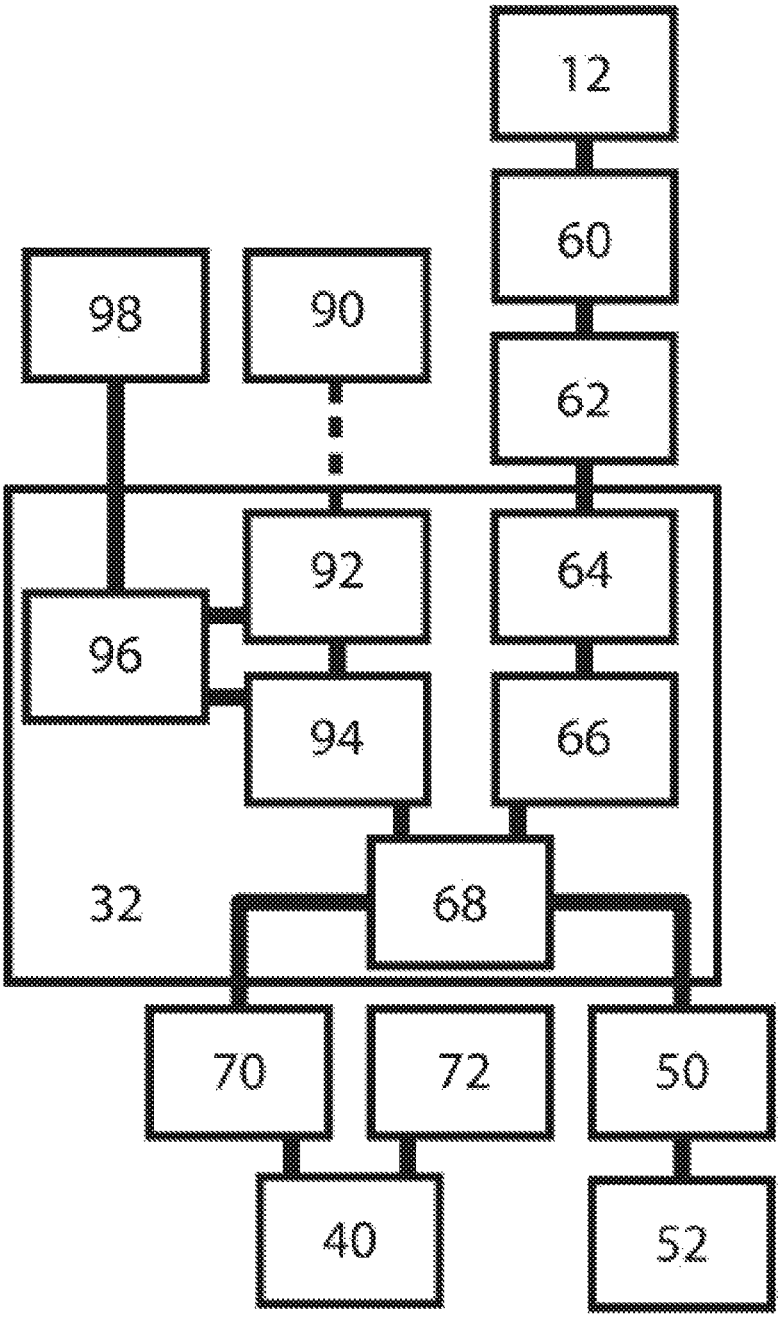
FIG. 2 is a block diagram of the pneumatic system and the control system of the present technology.

As shown in FIG. 2, the gas cylinder 12 is in fluid communication with a pressure gauge 60 and an adjustable pressure regulator 62. The pressure regulator 62 is for controlling the input pressure from the gas cylinder 12 in to a common pneumatic line 64. The preferred input pressure for the present technology is about 241 kilo Pascals (kPa), to about 310 kPa, and up to about 861 kPa and all pressures therebetween. The selected pressure is dependent on the type and weight of the gate being opened. The pressure regulator 62 is in fluid communication with the common pneumatic line 64, which is in fluid communication with a second pressure gauge 66 and a control valve 68. The control valve 68 is a 2 position, four way valve and is in fluid communication with each of an open gate pneumatic line 70, a closed gate pneumatic line 72 and the latch pneumatic line 50. The open and closed gate pneumatic lines 70, 72 are in fluid communication with the gate pneumatic ram 40. The control valve 68 is also in fluid communication with the latch pneumatic line 50, which in turn is in fluid communication with the latch pneumatic ram 52.

A 9 kg tank of compressed carbon dioxide set at 275 kPa can open an average gate about 2000 openings, which translates to 6 openings and closings per day for 333 days (this gate example is also opening the gate on an uphill driveway needing higher pressure to open gate on an angle, rather than on flat land).

A remote control transmitter 90 is in electronic communication with a remote control receiver 92, which in turn is in electrical communication with a solenoid actuator 94. Power is provided to the solenoid actuator with a battery 96, which is preferably a 12 volt battery. The battery 96 is recharged with a solar panel 98 in electrical communication with the battery 96. The gate gas line 64, second pressure gauge 66, control valve 68, remote control receiver 92, solenoid actuator 94 and battery 96 are preferably housed in the control box 32. The remote control transmitter 90 is preferably a push button device used in typical garage door opener products (typical device would be 12 v DC at 315 MHz). Pressing this device by the remote user will start the gate opening chain of events as described below.

Figure 3:
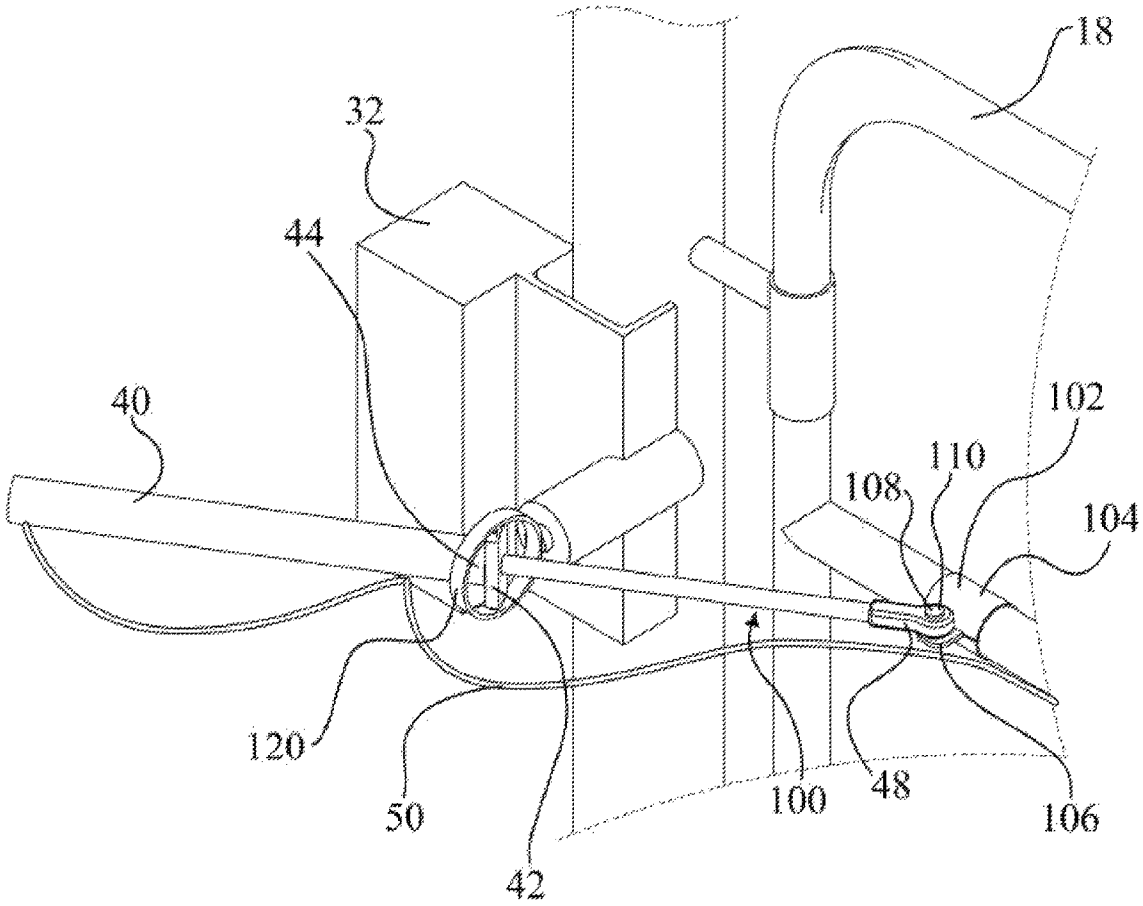
FIG. 3 is a side view of the gate pneumatic ram attached to the support and gate.

FIG. 3 details the gate pneumatic ram 40 arm connection to the gate 18 and control box 32. The piston of the gate pneumatic ram 40 (referred to as the gate piston 100) is affixed to the gate 18 with a clip-on fixture 102 that is two clips 104 and an aluminum flange 106. The flange 106 has an aperture 108 through which a bolt/nut combination 110 is used to secure the distal end 48 of the piston 100 to the flange 106 and therefore the gate 18. The location of this clip-on fixture 102 is based on specific gate dimensions and is placed to enable full gate closing and opening functionality. The clip-on fixture 102 also allows routing of the latch pneumatic line 50 to the latch pneumatic ram 52 (see FIG. 4). The gate pneumatic ram 40 mounting assembly 42 comprises a two dimensional gimbal 120 capable of 360 degrees movement in the horizontal plane in addition to movement in the vertical plane. Thus, as the pneumatic operation starts, gate pneumatic ram 40 can move in both horizontal and vertical planes simultaneously—this is to address the potential for gate movement in the vertical plane due to settling over time, etc.

Figure 4:
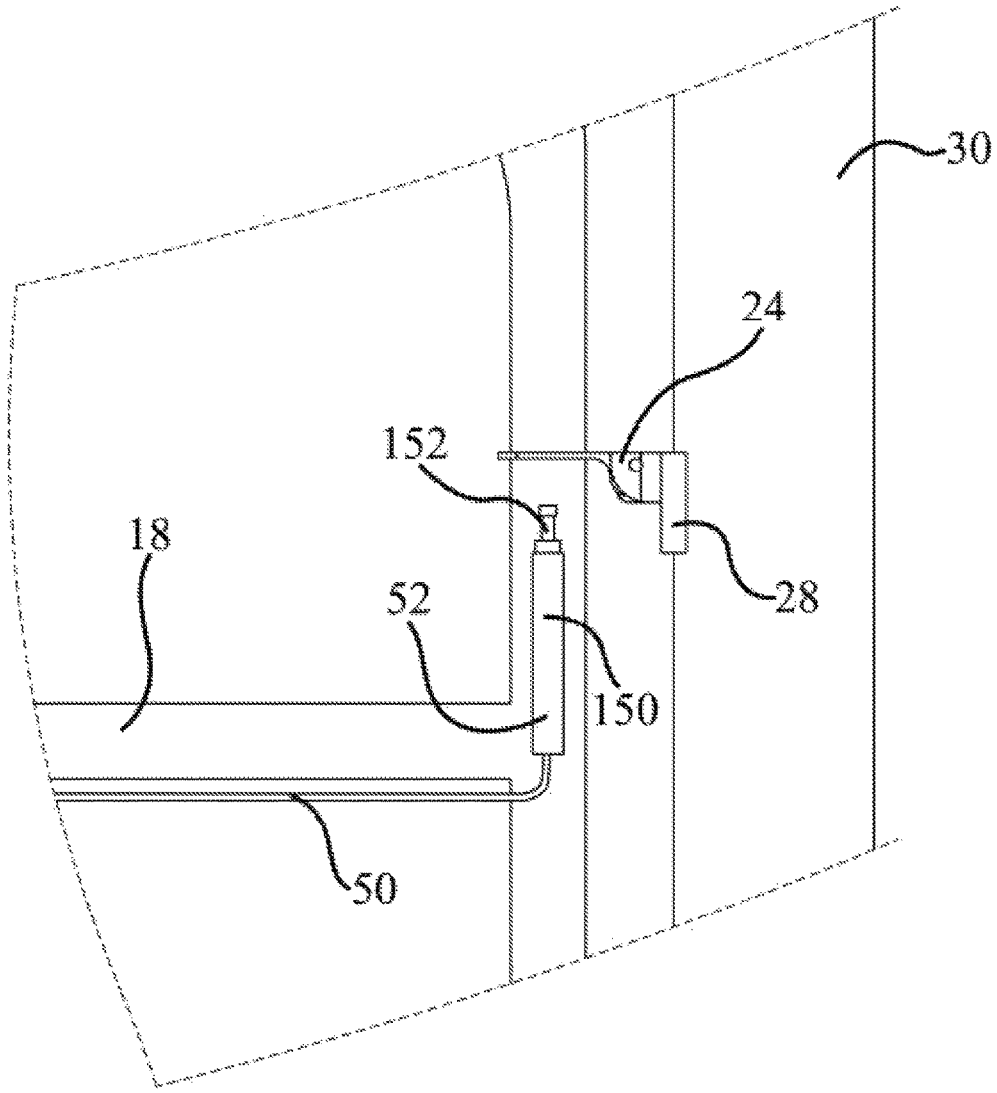
FIG. 4 is a side view of the latch mechanism.

FIG. 4 shows the latching mechanism. It includes the latch 24 and the keeper 28, which are on the second fence post 30 and the latch pneumatic ram 52, which is attached to the gate 18 and is aligned with the latch 24. The keeper 28 is spring-loaded and is a dual facing design enabling the gate to open/close in either direction. The latch pneumatic ram 52 has a spring 150 about the latch piston 152, and is therefore spring-loaded. The latch pneumatic line 50 is in fluid communication with the latch pneumatic ram 52.

Figure 5:
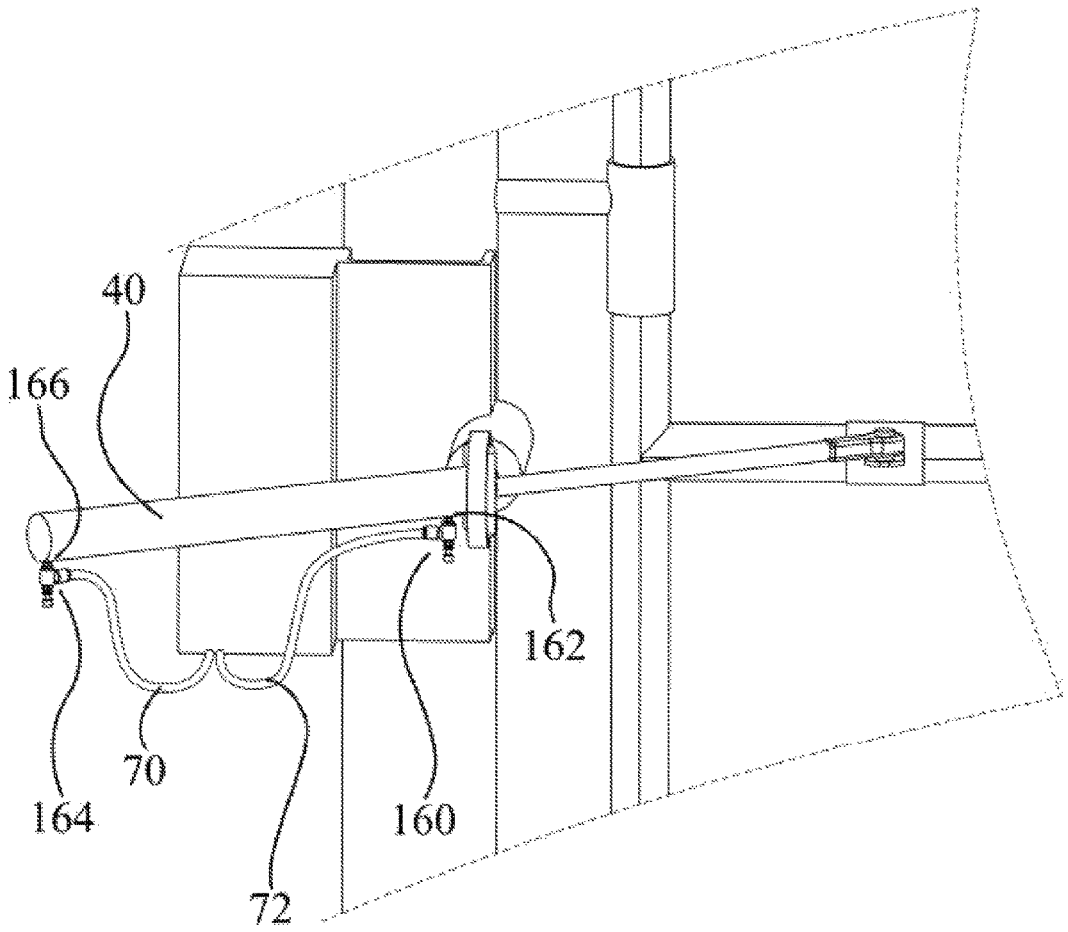
FIG. 5 is a side view of the gate pneumatic ram.

FIG. 5 shows the details of the gate pneumatic ram 40. A first adjustable valve 160 is located at a first outlet 162 and a second adjustable valve 164 is located at a second outlet 166. Alternatively, the first adjustable valve 160 and the second adjustable valve 164 are in line in the open gate pneumatic line 70 and the closed gate pneumatic line 72, preferably proximate the outlets 162, 166.

The adjustable valves allow for adjustment of flow rates when the gate is being installed, to adjust for desired speed of opening and closing, weight and length of gate, as well as to accommodate the environment, for example, the slope of the land. Further, adjustments can be made on the fly, as required.

Figure 6:
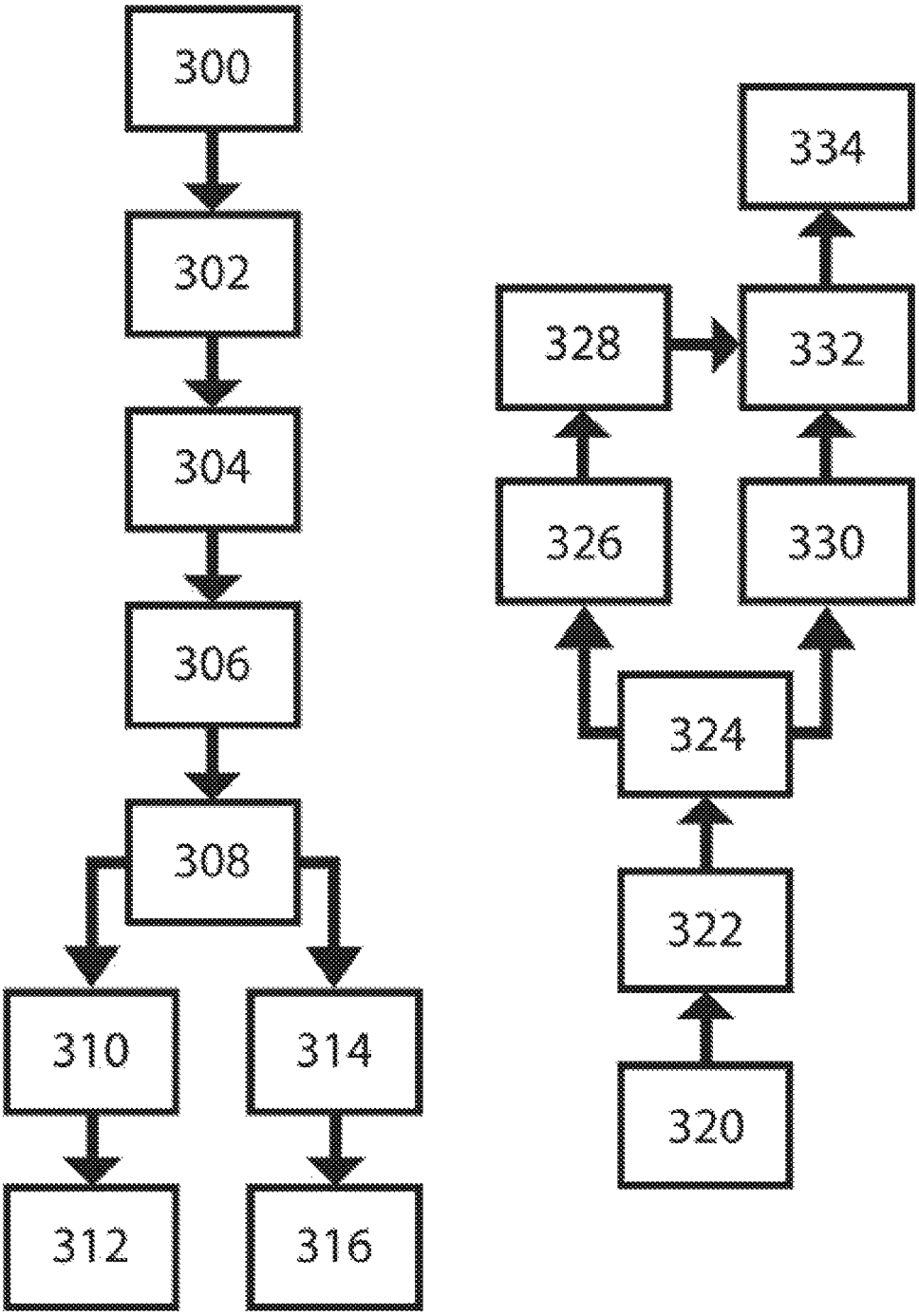
FIG. 6 is a block diagram of the method of using the present technology.

FIG. 6 shows the method by which the system operates. The remote control transmitter sends 300 a coded ON transmission. The remote control receiver receives 302 the coded ON transmission from the remote control transmitter. A voltage signal is sent 304 to the solenoid actuator. The solenoid actuator opens 306 the control valve. This actuates 308 both the gate pneumatic ram and the latch pneumatic ram. The latch piston rises 310 leading to the spring-loaded keeper rising 312, thus freeing the gate. Concomitantly, the gate piston is urged 314 outward, causing the gate to swing 316 open. Upon a second pressing of the remote control transmitter a coded OFF transmission is sent 320. The solenoid actuator de-activates 322 thus resulting in the control valve 68 closing 324. The gate piston retracts 326, causing the gate to be drawn 328 toward the closing position. Closing of the control valve also causes the latch piston to retract 330. Once the gate closes, the latch engages 332 the keeper, thus locking 334 the gate. The gate can be controlled to open inward or outward.

Figure 7:
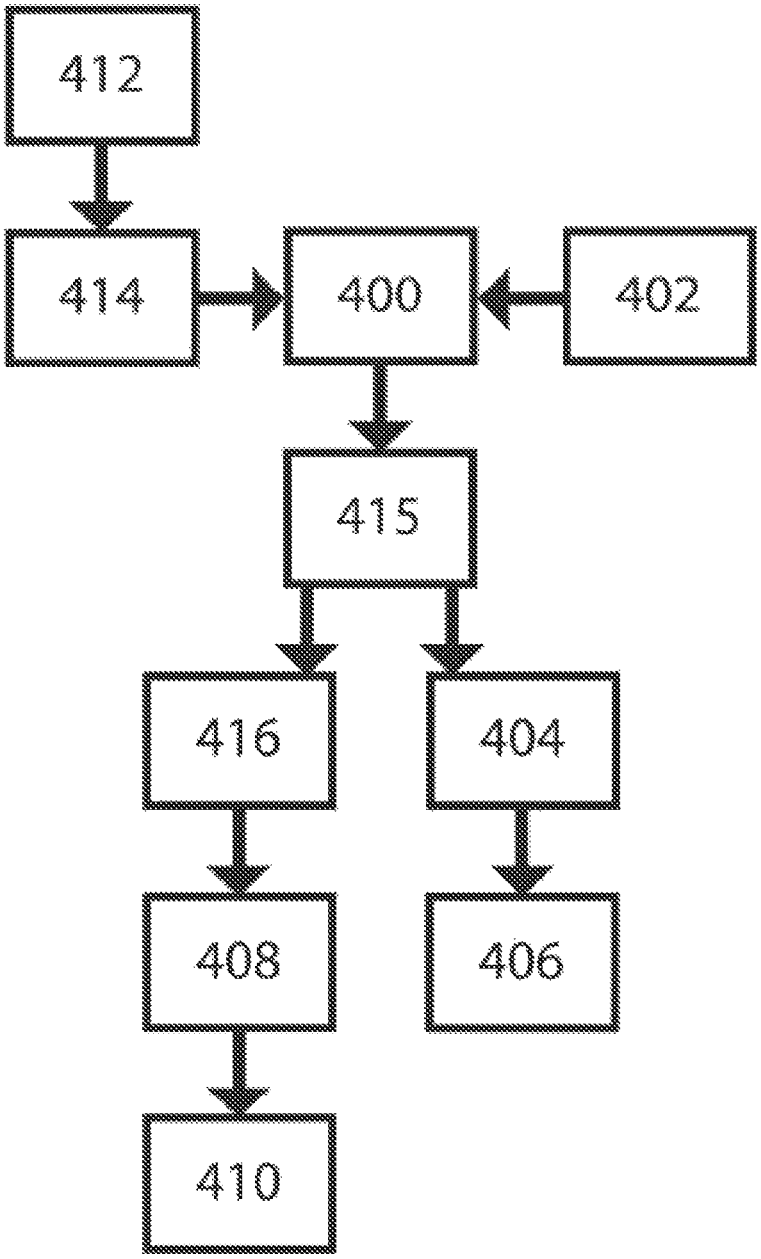
FIG. 7 is a block diagram of the method of installing and adjusting the present technology.

FIG. 7 outlines the steps taken to install and adjust the gate opener and closer. A user attaches 400 the control box to a suitable object close to the gate and attaches 402 the carbon dioxide cylinder proximate the controller and gate. Both may be attached to a gate post. The latch pneumatic line is attached 404 to the latch pneumatic ram. The latch pneumatic ram is attached 406 to the gate such that it is positioned to urge the keeper from an engaged position to a disengaged position. The latch pneumatic line is attached 408 to the gate as needed. The gate pneumatic ram is pivotally attached 410 to via a mounting assembly to the control box at a cylinder distal end and to a bracket on the gate at a piston distal end. A solar panel is located 412 in a suitable location and wired 414 to the battery that is housed, preferably, in the control box. The adjustable pressure regulator is adjusted 415 to provide sufficient pressure to actuate the rams. The rate of opening and closing of the gate is adjusted 416 using the adjustable valves on the gate pneumatic ram to adjust the flow rate.

The entire assembly may be provided, or a kit may be provided.

A smart phone could be used for the remote control functionality. Similarly, a Global Positioning System (GPS) could be integrated into the kit to replace the remote control functionality. Security codes could be added to cause the gate, for example, to close after a predetermined time.

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize, or be able to ascertain using no more than routine experimentation, many equivalents to the specific example embodiments specifically described herein. Such equivalents are intended to be encompassed in the scope of the claims, if appended hereto or subsequently filed.

What is claimed is:

1. A pneumatically actuated gate assembly, the assembly comprising: a gate with an at least one hinge; a battery; a compressed carbon dioxide cylinder; a first support pivotally supporting the gate with the at least one hinge; a second support; a latch movably mounted on the gate; a keeper for releasable engagement with the latch, the keeper mounted on the second support; a compressed gas system in fluid communication with the compressed carbon dioxide cylinder; a gate pneumatic system in fluid communication with the compressed gas system, and including a gate pneumatic ram pivotally attached to the first support at a proximal end and attached to the gate at a distal end; a latch pneumatic system in fluid communication with the compressed gas system, and including a latch pneumatic ram attached to the gate proximate a latch; and a controller, wherein the compressed gas system is configured to provide a controllable pressure of gas to the gate pneumatic system and the latch pneumatic system and is under control of the controller.

2. The assembly of claim 1, wherein the compressed gas system is configured to provide between about 241 kPa to about 861 kPa pressure when the controller is actuated.

3. The assembly of claim 2, wherein the controller is a solenoid actuator.

4. The assembly of claim 3, further comprising a first flow controller on a first outlet of the gate pneumatic ram and a second flow controller on a second outlet of the gate pneumatic ram.

5. The assembly of claim 4, wherein the first flow controller is a first adjustable valve and the second flow controller is a second adjustable valve.

6. The assembly of claim 5, further comprising a remote control transmitter and a remote control receiver, the remote control transmitter for electronic communication with the remote control receiver, the remote control receiver in electrical communication with the solenoid actuator.

7. The assembly of claim 6, wherein the gate pneumatic ram is attached at the proximal end to the gate with a mounting assembly that includes a two dimensional gimbal.

8. The assembly of claim 7, wherein the latch pneumatic ram is spring-loaded.

9. A method of opening and closing a gate and a latch, the method comprising utilizing the assembly of claim 1; adjusting a first adjustable valve on a first outlet of the pneumatic ram and adjusting a second adjustable valve on a second outlet of the pneumatic ram to control a speed of opening and closing the gate; actuating the controller; and deactuating the controller.

* * * * *